US011806723B2

(12) United States Patent
Swensen et al.

(10) Patent No.: US 11,806,723 B2
(45) Date of Patent: Nov. 7, 2023

(54) INTER-PARTICLE IMPINGEMENT FRACTURE OF HETEROGENEOUS MATERIAL

(71) Applicant: Omnis Mineral Technologies, LLC, Santa Barbara, CA (US)

(72) Inventors: James S. Swensen, Santa Barbara, CA (US); Simon K. Hodson, Santa Barbara, CA (US)

(73) Assignee: OMNIS ADVANCED TECHNOLOGIES, LLC, Santa Barbara, CA (US)

( * ) Notice: Subject to any disclaimer, the term of this patent is extended or adjusted under 35 U.S.C. 154(b) by 0 days.

(21) Appl. No.: 17/359,531

(22) Filed: Jun. 26, 2021

(65) Prior Publication Data

US 2021/0402411 A1 Dec. 30, 2021

Related U.S. Application Data

(60) Provisional application No. 63/044,819, filed on Jun. 26, 2020.

(51) Int. Cl.
*B02C 19/00* (2006.01)
*C10L 5/04* (2006.01)

(52) U.S. Cl.
CPC ..... *B02C 19/005* (2013.01); *C10L 5/04* (2013.01); *C10L 2290/28* (2013.01)

(58) Field of Classification Search
CPC ..... B02C 19/005; C10L 5/04; C10L 2290/28
See application file for complete search history.

(56) References Cited

U.S. PATENT DOCUMENTS 9,869,512 B1 1/2018 Gibbel
2011/0168819 A1* 7/2011 Wark ..... B02C 15/001 241/119

(Continued)

FOREIGN PATENT DOCUMENTS

WO 2016048793 A1 3/2016
WO 2020172319 A1 8/2020

OTHER PUBLICATIONS

Jan De Bakker, Energy Use of Fine Grinding in Mineral Processing, Metallurgical and Materials Transactions, vol. 1E, p. 9, Mar. 2014.

(Continued)

*Primary Examiner* — Latosha Hines
(74) *Attorney, Agent, or Firm* — KIRTON McCONKIE; Evan R. Witt

(57) ABSTRACT

A process for comminuting particles of heterogeneous material. The particles of heterogeneous material are fragmented and broken into smaller particle size by breaking them against each other. Heterogeneous material means two or more different solid materials or phases in the same solid. The component materials may have different specific gravity and/or hardness. In the process, a slurry of particles of heterogeneous material is pumped through an agitated mixture of impingement media, wherein the impingement media has a size greater than a size of the particles, wherein adjacent impingement media interact to create impingement zones through which the particles pass and impinge each other to cause the particles to fracture and break into smaller particles. The impingement media may be from 5 to 10 times larger than the particles. The impingement media may be harder than the particles. The heterogeneous material may be coal.

17 Claims, 7 Drawing Sheets

(56) References Cited

U.S. PATENT DOCUMENTS

| | | | | |
|---|---|---|---|---|
| 2018/0134977 | A1* | 5/2018 | Swensen | C10L 5/06 |
| 2019/0234854 | A1 | 8/2019 | Kersey et al. | |
| 2019/0338209 | A1 | 11/2019 | Yoon | |

OTHER PUBLICATIONS

P. Baláž, Chapter 2, High-Energy Milling, Mechanochemistry in Nanoscience and Minerals Engineering, pp. 103-132, 2008.

G.R. Ballantyne et al., Proportion of Energy Attributable to Comminution, 11th Mill Operators' Conference 2012, Hobart, pp. 25-30, Oct. 2012.

Tim Napier-Munn, Comminution Energy and How to Reduce it, CEEC (Coalition for Eco-Efficient Comminution), 2012.

A. Jankovic et al., Fine Grinding in the Australian Mining Industry, Metso Minerals Process Technology Australia and Asia-Pacific, 2008.

Jack Jeswiet et al., Energy Consumption in Mining Comminution, Procedia CIRP 48 (2016) 140-145.

Claire Mayer-Laigle et al., Comminution of Dry Lignocellulosic Biomass: Part II. Technologies, Improvement of Milling Performances, and Security Issues, Bioengineering, 2018, 5, 50.

David Rahal et al., Knelson-Deswik Milling Technology: Bridging the Gap between Low and High Speed Stirred Mills, Proceedings of the 43rd Annual Meeting of the Canadian Mineral Processors, Jan. 2011.

Mining Industry Bandwidth Study, U.S. Department of Energy, Industrial Technologies Program, Jun. 2007.

N. Stehr, R. K. Mehta & J. A. Herbst (1987) Comparison of Energy Requirements for Conventional and Stirred Ball Milling of Coal-Water Slurries, Coal Preparation, 4:3-4, 209-226, DOI: 10.1080/07349348708945533.

* cited by examiner

INTER-PARTICLE IMPINGEMENT FRACTURE OF HETEROGENEOUS MATERIAL

CROSS-REFERENCE TO RELATED APPLICATION

This application claims the benefit of U.S. Provisional Application No. 63/044,819, filed Jun. 26, 2020, which application is incorporated by reference.

BACKGROUND OF THE INVENTION

This disclosure relates to a process for reducing the size of particles of heterogeneous material. More specifically, particles of heterogeneous material are broken into smaller particle size by breaking them against each other. As used herein, heterogeneous material consists of two or more different solid materials or phases in the same solid particle. The component heterogeneous materials may have different specific gravity and/or hardness.

Comminution is the reduction of solid materials from one average particle size to a smaller average particle size. Traditional comminution is done by physical means through various milling, grinding, or abrasion attrition methods. Milling includes crushing or pulverizing particles by pressure or force so as to reduce the particle size. Grinding reduces material to a powder or small fragments by friction. Abrasion and attrition, like grinding, include rubbing or wearing away material by friction.

In mining, ore is initially reduced in size by crushing rock to a size that makes it manageable or more stable. "Crushing is accomplished by compression of the ore against [harder] rigid surfaces, or by impact against surfaces in a constrained motion path. Crushing is usually a dry [or semi-dry] process, and is performed in several stages, reduction ratios being small, ranging from three to six in each stage. The reduction ratio of a crushing stage can be defined as the ratio of maximum particle size entering to maximum particle size leaving the crusher, although other definitions are sometimes used. There are a number of crushers available such as jaw, gyratory, cone, roll, and impact crushers." Jack Jeswiet et al., Energy Consumption in Mining Comminution, Procedia CIRP 48 (2016) 140, 142.

"Energy efficiency is low in grinding processes where most of the energy is dissipated as heat in the rock. Additionally, there is high variability between mine ore hardness and size distribution in feeding the grinding process, giving different inefficiencies." Id.

Grinding can be classified into coarse, intermediate, and fine grinding processes. These differ in the equipment used, the product sizes attained, and the comminution mechanisms used. The boundaries between these size classes must always be drawn somewhat arbitrarily. Jan De Bakker, Energy Use of Fine Grinding in Mineral Processing, Metallurgical and Materials Transactions, Vol. 1E, p. 9, March 2014, discloses the boundaries set forth in Table 1.

TABLE 1

Comminution Equipment, Size Classes, and Grinding Mechanisms

| Grinding Level | Equipment | "Typical" P80 (μm) | Dominant Breakage Mechanism |
|---|---|---|---|
| Coarse | AG/SAG mill | 500 to 10,000 | Impact + abrasion + attrition |
| Intermediate | Ball mill | 40 to 400 | Impact +attrition |
| Intermediate | Tower mill | 40 to 400 | Attrition |
| Fine | Stirred mills | <30 | Attrition |

As shown in Table 1, coarse grinding typically corresponds to using an autogenous (AG) or semi-autogenous (SAG) mill; intermediate grinding typically uses a ball mill or tower mill; and fine grinding uses a stirred mill, such as an Isamill or Stirred Media Detritor (SMD). Of course, various exceptions to these typical values can be found. In fine grinding, a material with an P80 of less than 100 μm may be comminuted to a P80 of about 7 to 30 μm. The feed is typically a flotation concentrate, which is re-ground to liberate fine particles of the valuable mineral. The three modes of particle breakage are impact, abrasion (in which two particles shear against each other), and attrition (in which a small particle is sheared between two larger particles or media moving at different velocities). In fine grinding, breakage is dominated by attrition alone. In stirred mills, this is accomplished by creating a gradient in the angular velocity of the grinding media along the mill's radius.

Stirred mills operate by stirring media, such as sand or metal balls or ceramic balls. In stirred-medium mills, the stirrers set the contents of the mixing chamber in motion, causing intensive collisions between the grinding medium and the ore particles and between the ore particles themselves. The grinding action is by attrition and abrasion, in which very fine particles are chipped from the surfaces of larger particles, rather than impact breakage.

In summary, most milling is mechanical grinding of a hard surface against a weaker surface. When a particle is accelerated against a hard surface, the hard surface shatters the particles. Over time the hard surface against which the particles are accelerated (wear plates, media, container sidewalls, etc.) is worn down; the milled material is further contaminated with the worn particles from the hard surfaces.

Reduction of particles' sizes to less than 1 mm is very energy intensive because the surface contact area decreases as particles becomes increasingly smaller. Milling at mines accounts for about 3% to 5% of the world's energy consumption. Comminution or grinding in mining is about 40% of energy usage. Generally, the smaller the particle size produced via comminution, the greater the energy requirement to produce it; the energy required increases exponentially with smaller particle size.

Traditional comminution or milling of particles consumes high energy per ton of dry feedstock. The constant collisions of the milling media with each other and the material to be milled results in a conversion of kinetic energy to thermal energy. A significant amount of waste heat is produced, requiring cooling water to keep the system from overheating. The media is also milled or consumed over time during traditional comminution or milling of particles. The media includes hard particles that are usually larger than the particles being milled. In traditional comminution, media functions as a collision and grinding surface for the particles being milled.

When particles of heterogeneous material are reduced in size, the traditional methods reduce the size of all or both components of the heterogeneous material. This is particularly undesirable if one of the component materials has significantly lower value than the other or if separation of the component materials is the ultimate desired outcome.

As particle size reduction is a common practice across many industries, it would be an advancement in the art of particle size reduction to provide a new comminution process that consumes less energy. It would be a further advancement in the art to provide a new comminution process that minimizes wear of milling media. It would be an even further advancement in the art to reduce the size of one of the components of a heterogeneous material without reducing the size of the other component(s).

REFERENCES

Jan De Bakker, Energy Use of Fine Grinding in Mineral Processing, *Metallurgical and Materials Transactions*, Vol. 1E, p. 9, March 2014.

P. Baláž, Chapter 2, High-Energy Milling, *Mechanochemistry in Nanoscience and Minerals Engineering*, pp. 103-132, 2008.

G. R. Ballantyne et al., Proportion of Energy Attributable to Comminution, 11$^{th}$ *Mill Operators' Conference* 2012, Hobart, pp. 25-30, October 2012.

Tim Napier-Munn, Comminution Energy and How to Reduce it, CEEC (Coalition for Eco-Efficient Comminution), 2012.

A. Jankovic et al., Fine Grinding in the Australian Mining Industry, *Metso Minerals Process Technology Australia and Asia-Pacific,* 2008.

Jack Jeswiet et al., Energy Consumption in Mining Comminution, *Procedia* CIRP 48 (2016) 140-145.

Claire Mayer-Laigle et al., Comminution of Dry Lignocellulosic Biomass: Part II. Technologies, Improvement of Milling Performances, and Security Issues, *Bioengineering,* 2018, 5, 50.

David Rahal et al., Knelson-Deswik Milling Technology: Bridging the Gap between Low and High Speed Stirred Mills, *Proceedings of the* 43$^{rd}$ *Annual Meeting of the Canadian Mineral Processors*, January 2011.

Mining Industry Bandwidth Study, U.S. Department of Energy, Industrial Technologies Program, June 2007.

SUMMARY OF THE INVENTION

This disclosure relates to a process for comminuting particles of heterogeneous material, that is, reducing solid materials from one particle size population or distribution to a smaller particle size population or distribution. Commercially available particle size analyzers may be used to determine a particle size distribution from which an average particle size, and a median particle size, as well as other distribution defining terms, are determined. As used herein and unless specifically defined otherwise, the term "particle size" refers to median particle size or a "d50" size on a particle size distribution. The term "d50" size value means that 50% of the particles in the sample are smaller than the size value. Thus, d50, by definition, is the median particle size. More generally, "dXX" size value means that XX % of the particles in the sample distribution are smaller than the size value. Particle sizes of d90 and d99 are also referenced herein. For example, a particle size of d99 200 microns (XX=99 and "size value"=200 microns) means 99% of the particles have a size below 200 microns. While a particle size of d50 indicates a median particle size, a particle size of d99 indicates an upper limit particle size.

The particles of heterogeneous material are fragmented and broken into smaller particle size by breaking them against each other. Heterogeneous material means two or more different solid materials or phases in the same solid. Thus, as used herein, "particles of heterogeneous material" means particles having two or more different solid materials or phases in the same solid. The component solid materials or phases of the heterogeneous material may have different specific gravity and/or hardness.

The disclosed process for comminuting particles of heterogeneous material includes obtaining a quantity of particles, wherein the particles comprise heterogeneous material having at least two distinct solid materials having different hardness and specific gravity. A slurry of the particles is pumped through an agitated mixture of impingement media, wherein the impingement media has a size greater than a size of the particles, wherein adjacent impingement media interact to create impingement zones through which the particles pass and impinge each other to cause the particles to fracture and break into smaller particles.

The impingement media may have a size from 5 to 10 times larger than the size of the particles.

The impingement media may be harder than the particles.

The impingement media may have a size from 2 to 3 mm and the particles may have a size less than d99 0.3 mm.

The impingement media may have a size from 0.5 mm to 1 mm and the particles have a size less than d99 0.1 mm.

In an embodiment, the at least two distinct solid materials may comprise coal-derived carbonaceous matter and coal-derived mineral matter.

In an embodiment, the smaller particles formed in the disclosed process for comminuting particles may have a size less than 90% the size of the feed particles.

In an embodiment, the smaller particles formed in the disclosed process for comminuting particles may have a size less than 80% the size of the feed particles.

In an embodiment, the smaller particles formed in the disclosed process for comminuting particles may have a size less than 70% the size of the feed particles.

In an embodiment, the smaller particles formed in the disclosed process for comminuting particles may have a size less than 60% the size of the feed particles.

In an Embodiment, the Smaller Particles Formed in the Disclosed Process for Comminuting Particles May have a Size Less than 50% the Size of the Feed Particles.

In an embodiment, the smaller particles formed in the disclosed process for comminuting particles may have a size less than 40% the size of the feed particles.

In an embodiment, the smaller particles formed in the disclosed process for comminuting particles may have a size less than 30% the size of the feed particles.

In an embodiment, the smaller particles formed in the disclosed process for comminuting particles may have a size less than 20% the size of the feed particles.

In an embodiment, the smaller particles formed in the disclosed process for comminuting particles may have a size less than 10% the size of the feed particles.

Thus, the smaller particles formed in the disclosed process for comminuting particles may have a particle size less than 10%, 20%, 30%, 40%, 50%, 60%, 70%, 80%, or 90% the size of the feed particles, wherein any of the stated values can form an upper or lower endpoint of a range.

The disclosed process may require an energy amount less than 10 kwh/MT (kilowatt-hour per metric ton) of dry feed particles.

The disclosed process may require an energy amount less than 5 kwh/MT of dry feed particles.

The disclosed process may require an energy amount less than 3 kwh/MT of dry feed particles.

The disclosed process may require an energy amount less than 2 kwh/MT of dry feed particles.

A process is disclosed to reduce a particle size of particles, wherein the particles comprise at least two dissimilar solid phases of different hardness. The process includes suspending the particles in a moving fluid and causing the particles to impinge each other and fracture at an interface between the solid phases.

In an embodiment of the process, the harder phase and the softer phase have an initial size, wherein the size of the softer phase is reduced without substantially reducing the size of the harder phase.

As used herein, the size of a particle or particle size may be measured using any known or novel technique. For example, particle size may be determined using sieves. Particle size may be determined using a particle size analyzer. Particle size analyzers may be based on different technologies, including particle light scattering, gravitational settling of the particle, and high definition image processing. For submicron particle measurement, dynamic light scattering is preferred. For measuring particles from hundreds of nanometers to several millimeters, laser diffraction, also called static laser light scattering, is preferred.

It is to be understood that both the foregoing general description and the following detailed description are exemplary and explanatory and are not restrictive of the invention, as claimed. It is understood that specific aspects and features of the disclosed invention may be freely combined with other specific aspects and features of the disclosed invention. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DESCRIPTION OF THE INVENTION

Figure 1:
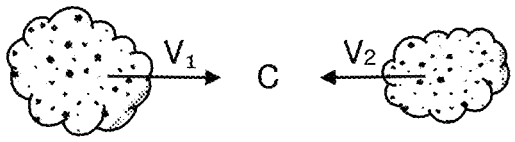
FIG. 1 illustrates two particles of heterogeneous material impinging or colliding with each other.

This disclosure relates to a liquid comminution of particles of heterogeneous material. The heterogeneous material of which the particles consist has two or more different, or heterogeneous, materials in the same solid. The different materials may have different density and/or hardness. In the disclosed process, particles of heterogeneous material fracture at the interface of the heterogeneous materials as the particles pass through tortuous impingement pathways.

In the disclosed process, a slurry containing particles of heterogeneous material flows through an agitated mixture of the slurry and impingement media. The agitated impingement media create a tortuous pathway of impingement zones between adjacent media surfaces. Particles of heterogeneous material are induced to impinge each other within the tortuous pathway of impingement zones, causing the particles to fracture. As used herein, an impingement zone is a channel or gap formed between the impingement media through which the particles in the slurry must pass or traverse. The particles are forced through these numerous impingement zones by the pressure and flow of the slurry, resulting in tortuous pathways through the agitated impingement media.

Without being bound by theory, when particles in the slurry are forced through impingement zones, the small particles are accelerated into the smaller channel between the larger media. At some point the fine particles reach an impingement point where they cannot traverse the impingement pathway because the particles of heterogeneous material are larger than the impingement zone or because two or more particles try going through the same impingement zone and are impeded or impinged. The restriction causes the particles to rapidly decelerate. The particles of heterogeneous material collide with each other and/or with the impingement media which forms the impingement zone. The deceleration and inter-particle collisions that occur cause shear forces on the particles of heterogeneous material. The interfaces between the heterogeneous solid phases are not as strong as the individual solid phases themselves. The shear forces cause the particles to fracture at the interfaces between the heterogeneous solid phases. Thus, particles of heterogeneous material passing through the tortuous pathway of impingement zones induce fracture of the particles.

A typical particle of heterogeneous material likely passes through multiple impingement zones between impingement media to reach a minimum particle size. A minimum particle size within the scope of the disclosed process exists where there are no longer any interfaces between the heterogeneous solid phases where fracture can occur. Once this limit has been reached, i.e., because there are no more fracturable interfaces between heterogeneous solid phases, further size reduction by inter-particle impingement becomes inefficient. If further size reduction is desired, traditional comminution or milling processes may be utilized. The energy for particle size reduction according to the disclosed process is significantly lower compared to traditional comminution or milling methods.

As noted above, the disclosed process reduces the size of particles of heterogeneous materials by breaking the particles against each other. A particle of heterogeneous material is composed of two or more different solid phases or materials in the same particle.

One non-limiting example of a heterogeneous material is coal. Coal is a naturally occurring fossilized composite mixture of two or more solid materials, containing predominantly carbonaceous matter (carbon based) and mineral matter (non-carbon based) in the same particle. As used herein, the carbonaceous matter is referred to as coal-derived carbonaceous matter and the mineral matter is referred to as coal-derived mineral matter. As the particle contains two or more distinct or different solid materials, it is heterogeneous. In general, the carbonaceous matter makes up between about 70% to 95% by weight of the particles, and the mineral matter, sometimes referred to as inherent mineral matter or entrained mineral matter, makes up from 5% to 30% by weight of the particles.

The carbonaceous matter and mineral matter have different specific gravity and hardness. The specific gravity and hardness of carbonaceous matter and mineral matter may vary from one coal deposit to another. In one non-limiting example, the carbonaceous matter component has a specific gravity of about 1.2 and the mineral matter components have a specific gravity of about 2.45. The hardness of the carbonaceous matter is about 3 on a Mohs scale. The hardness of the mineral matter is about 4.5 to 7 on a Mohs scale.

In the disclosed process, it is observed that the softer material is reduced in particle size while the harder material remains substantially the same size it was in the original heterogeneous material. This is particularly true when the softer material comprises a majority of the matrix of the heterogeneous material.

Heterogeneous interfaces exist between the carbonaceous matter and mineral matter in coal particles. When a coal particle experiences the impact and shear forces described above for the tortuous impingement pathway process, the particles fracture at the heterogeneous interfaces.

Pieces or particles of a heterogeneous material are suspended in a carrier fluid to form a slurry. The carrier fluid may be aqueous or non-aqueous. Non-limiting examples of carrier fluid include water and diesel fuel. The particles are agitated sufficiently to keep the particles in suspension and move with respect with one another. The movement with respect to one another results in inter-particle impingement that causes fracture of the particles' heterogeneous material at the heterogeneous interfaces.

Larger material or media of equivalent or greater hardness can be blended into the slurry suspension to enhance the impingement effect. Preferably the added material or media are at least 5 to 10 times the diameter of the particles of heterogeneous material being comminuted. Since the added media is at least as hard or harder than the particles of heterogeneous material, little or no wear of the media occurs.

The disclosed process takes advantage of the differential specific gravity of the two or more materials in the particles. Using coal as an example, carbonaceous matter has a specific gravity of about 1.2, and mineral matter has a specific gravity of about 2.45. An illustration of two particles of heterogeneous material impinging or colliding with each other is shown in FIG. 1. The higher the velocity of a particle ($V_1$ or $V_2$), the higher the differential momentum for each heterogeneous material inside each particle. The differential momentum as two or more particles collide, with differential vectors, velocities, or inertia, can create intra-particle fracture at heterogeneous interfaces. If the particles were of homogeneous material, such inter-particle interaction, e.g. particle-to-particle interaction, would only promote "roundness", or surface roughness/texture, but would not significantly reduce average particle size or total surface area.

FIG. 1 shows two heterogeneous particles are moving with respect to one another, each with a different velocity, denoted by $V_1$ and $V_2$, respectively. C is the point of collision. The velocity difference ($\Delta V$) is the difference of the velocities, $V_1$ and $V_2$. Acceleration is measured by the change in velocity. High velocities can cause a large velocity difference ($\Delta V$) at collision (C), which also can result in a large acceleration change ($\Delta A$). Higher particle velocities also reduce the viscosity of the liquid-particle system. Higher particle velocity also permits higher particle loading in the slurry. The more particle loading in the liquid-particle system, the more effective the "particle-to-particle" effect.

The different heterogeneous materials in the particle possessing different specific gravities experience differential momentum while in motion. When the particles collide, the momentum of the heterogeneous materials in a given particle changes, resulting in differential collision forces within the particle. Internal stress occurs at the heterogeneous interfaces, which results in fault line formation and eventually fracture along the heterogeneous interfaces.

Figure 2:
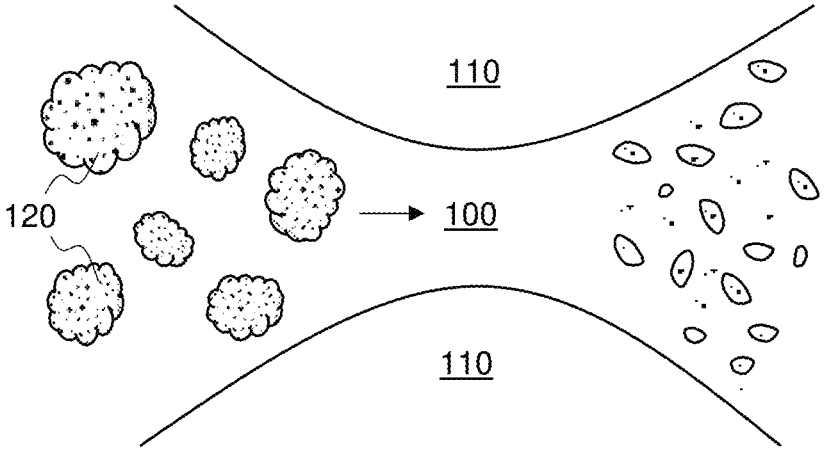
FIG. 2 illustrates the operation of an impingement zone between spherical media.

FIG. 2 shows an impingement zone 100 between spherical media 110. The impingement zone 100 may be a narrow channel, gap, or other flow restriction. The impingement zone 100 represents the space between media and particles, through which particles of heterogeneous material 120 are being forced. Forcing the particles of heterogeneous material through the impingement zone 100 results in the inter-particle collision or impingement effect that causes particle fracture along the heterogeneous interfaces. One can reasonably expect a 6:1 to 10:1 reduction in size for particle impingement in the impingement zone. The higher the particle velocity at impingement, the greater the particle size reduction. Increasing the particle velocity at impingement, increases the effectiveness of the process.

Figure 3:
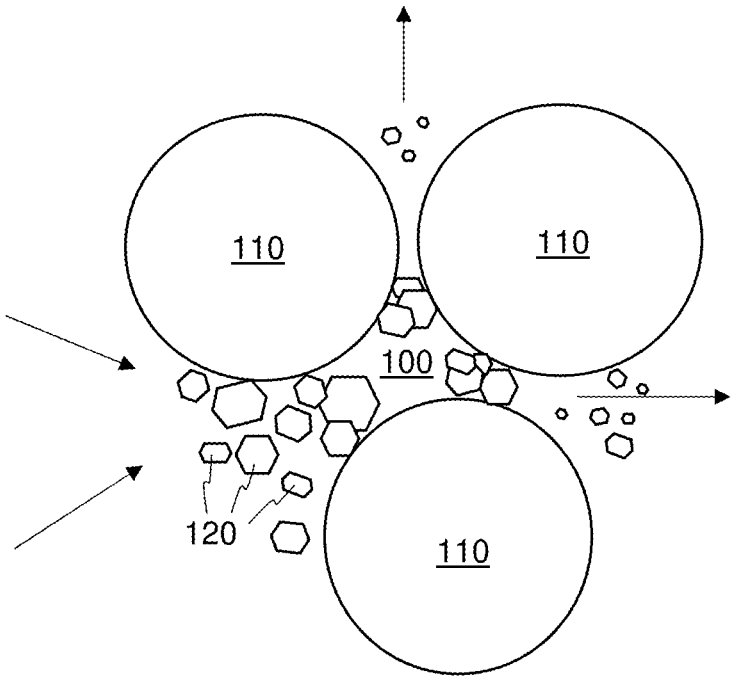
FIG. 3 illustrates the operation of impingement zones between spherical media.

FIG. 3 shows a similar view of particles of heterogeneous material 120 passing through impingement zones formed between spherical media 110. It is intended that multiple particles could be forced through an impingement zone at the same time, causing impingement of multiple particles.

If the particle-loaded fluid pushes against a higher specific gravity spherical media, and the particles have a higher specific gravity than the fluid and a lower specific gravity than the media, the net effect is to adjust the gap, dynamically, between the larger media particles to allow "impingement gaps" that are the optimal size to effectively produce the fracture event. It is also complex, but self-regulating, regardless of the fluid velocity.

It will be appreciated that the higher the slurry solids loading, the more effective the "particle-to-particle" impingement effect.

The media preferably has a diameter at least twice the diameter of the particles of heterogeneous material that are being reduced in size. In one non-limiting embodiment, the media may be 5 times the diameter of the particles of heterogeneous material. In another embodiment, the media may be 10 times the diameter of the particles of heterogeneous material. In another embodiment, the media may be 100 times the diameter of the particles of heterogeneous material. Thus, the media may be 2, 5, 10, 15, 20, 25, 30, 35, 40, 45, 50, 55, 60, 65, 70, 75, 80, 85, 90, 95, or 100 times the diameter of the particles of heterogeneous material, wherein any of the stated values can form an upper or lower endpoint of a range.

The media should be homogeneous such that it does not experience the impingement fracture pathway for particle size reduction like the particles of heterogeneous material described herein. In one non-limiting embodiment, the media has a hardness greater than the majority component of the heterogeneous material. Spherical media is presently preferred because angular media often breaks down until it becomes spherical.

Examples of common media include, but are not limited to, spherical silica sand, spherical corundum, spherical porcelain, spherical garnet, spherical silica, spherical alumina, spherical zirconia, etc.

In one non-limiting embodiment, the diameter of a given media has a narrow size distribution ranging from a size of X to 2X, wherein X is the smallest diameter size of the media and 2X is the largest diameter size of the media. For example, the media diameter could range between 1.5 to 3 mm or between 2 to 4 mm or between 2.5 and 5 mm or between 5 and 10 mm.

Without being bound by theory, the mechanism for the disclosed comminution process and device can be described as impingement induced particle-against-particle fracture. Particle breakage occurs as particles are forced through multiple impingement points in the comminution device. High efficiency fracture of heterogeneous particles occurs at these impingement points.

Figure 4:
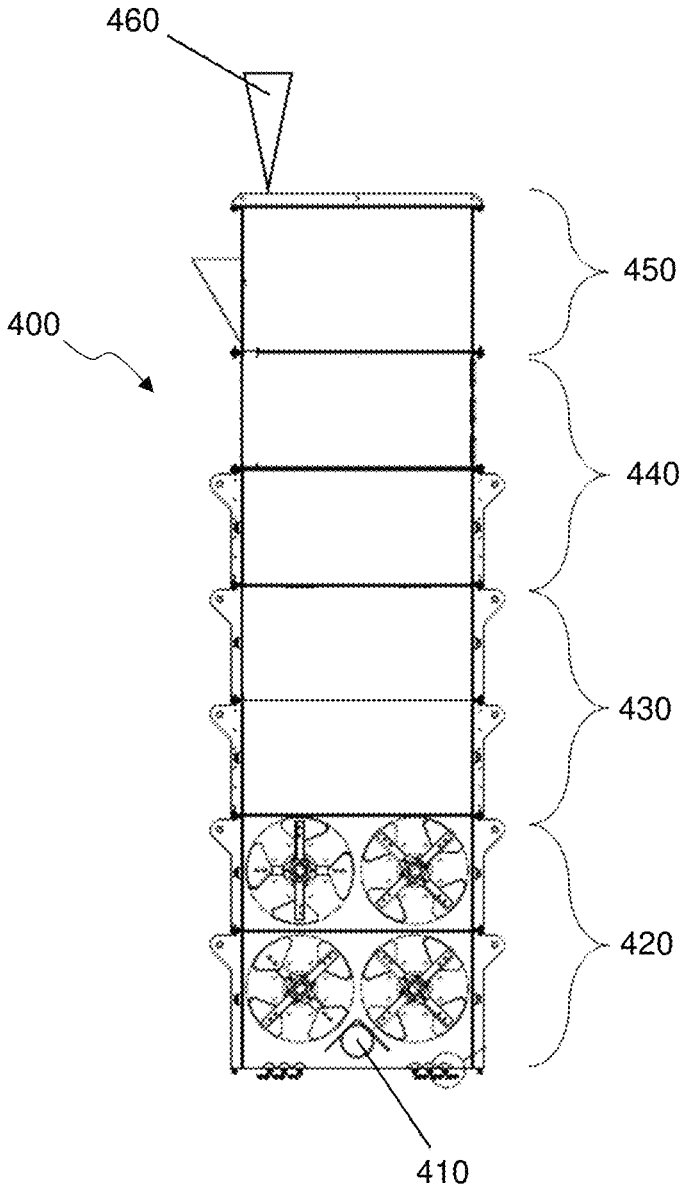
FIG. 4 shows an impingement fracture device.

FIG. 4 shows a process flow through a device 400 that causes impingement fracture of particles of heterogeneous material. The impingement fracture device 400 is a continuous liquid comminution device based on impingement induced particle fracture of heterogeneous material. Liquid comminution requires two components: media and slurry. The media may be 5 to 10 times or more larger than the material to be comminuted. The media is preferably harder than the material to be comminuted. Usually, media fills about 50 to 55% of the comminution volume. The slurry can range from 25 to about 55 wt. % solids. The slurry consists of a carrier fluid and the particles of heterogeneous material. Usually, the carrier fluid of the slurry is water, but a non-aqueous carrier fluid may also be used. The slurry fills about 40 to 45% of the comminution volume.

Unprocessed slurry is pumped into the impingement fracture device 400 at a slurry injection port 410 on the bottom of a first agitation zone 420. The first agitation zone 420 is a mechanical mixing zone. Mechanical mixers agitate the viscous fluid consisting of carrier fluid, media, and solid particles in the amounts discussed above. A second agitation zone 430 undergoes flow mixing. There is no physical agitation. The agitation action of the mixers in the first agitation zone 420 are felt in a decreasing manner as the height increases above agitation zone 420, up to about the top of the second agitation zone 430.

A settling zone 440 above the first and second agitation zones experiences very little agitation from the first agitation zone 420. The media settles against the rising slurry velocity back to the top of the second agitation zone 430 where it is mixed back into the media in the mixing system. The settling zone is less viscous because less media is found in this zone. A fractured slurry discharge and media recycling zone 450 is located at the top of the settling zone 440, only about 5 volume percent of media remains in zone 450 when the device is operating with continuous input of unprocessed slurry at the bottom of the first agitation zone 420.

The fractured slurry that discharges from the top of the impingement fracture device 400 is pumped to a hydrocyclone 460 above the zone 450. The fractured slurry exits the top of the hydrocyclone and goes to downstream processes. The media that remained in the fractured slurry upon discharging from the device (generally about 5% by volume) exits the bottom of the hydrocyclone and falls back down into the device 400 at the top of the zone 450.

Figure 4A:
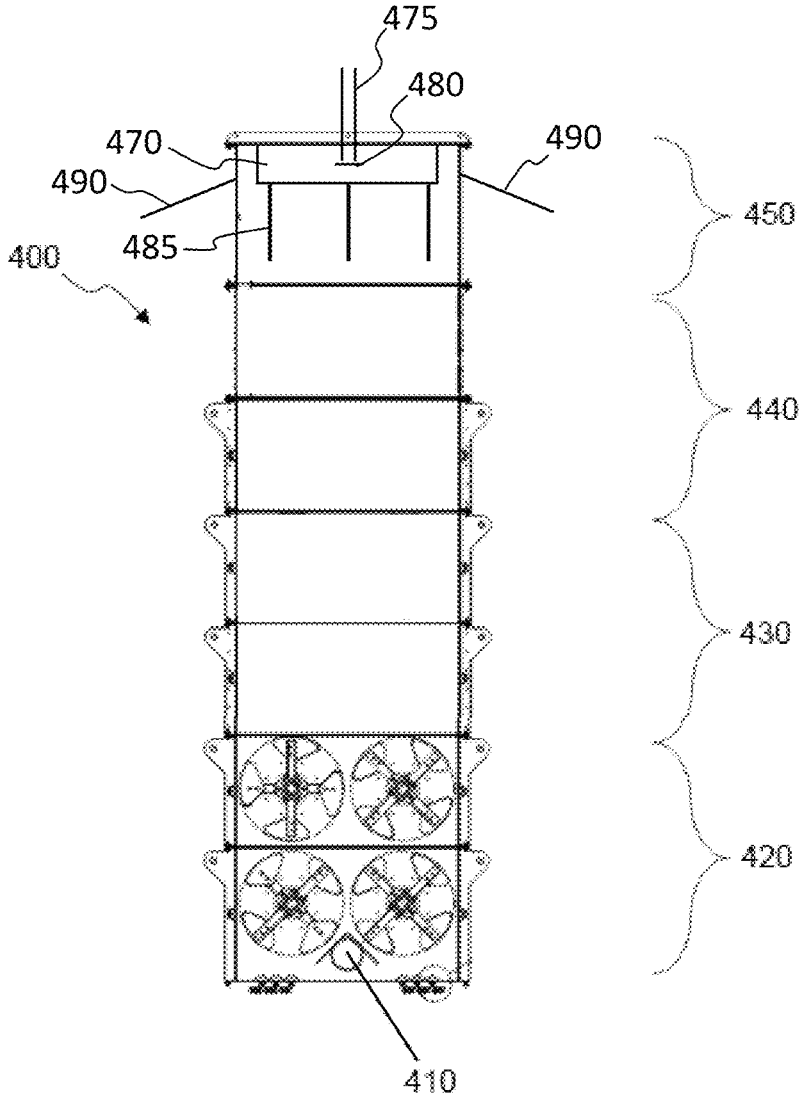
FIG. 4A shows a modified impingement fracture device based upon the device shown in FIG. 4.

FIG. 4A shows a modified impingement fracture device 400 which provides for dilution water to be added locally at the top of the mill in zone 450. Dilution water is pumped into a container 470 that defines a volume top of the impingement fracture device 400. The water enters the container 470 via a pipe 475 with a splash plate 480. The splash plate 480 causes the water to discharge horizontally into the container 470 and distribute more evenly throughout the container 460.

Figure 4B:
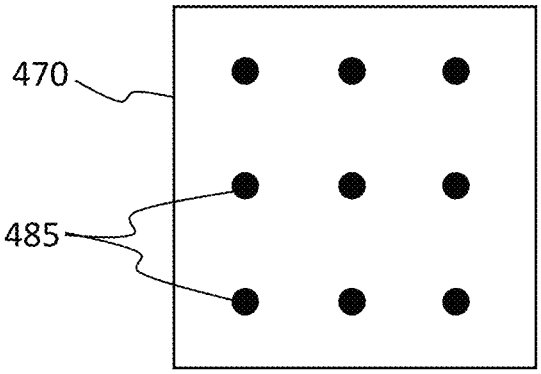
FIG. 4B shows an exemplary downpipe grid configuration.

A grid of downpipes 485 extend downward from the container 470 into zone 450. One example of a grid configuration for downpipes 485 is shown in FIG. 4B. FIG. 4B shows nine downpipes 485 distributed throughout the bottom of container 470. It will be understood that more downpipes or fewer downpipes may be used depending upon the size of container 470, the size of the downpipes, and the desired dilution water flow rate into mill zone 450.

The water added into the container 470 gravity drains through the downpipes 485 into the mixture of slurry and remaining media in zone 450 to locally dilute the slurry and media within zone 450. If the slurry is diluted to less than 20% solids, the media readily settles or falls through the slurry in zone 450 back to the mixing zones below. Dilution to less than 15% can be done to facilitate fast settling of media back into the mixing zones below. In one preferred embodiment, the solids content is diluted to about of 15% by weight. In another embodiment, the solids content is diluted to about 10% by weight. In another embodiment, the solids content is diluted to about 5% by weight. However, if too much dilution water is added, it can cause dilution in the lower mixing zones and decrease the performance of the impingement mill.

The dilute slurry discharges out of the top of the impingement mill into gutters or launders 490 that direct the dilute slurry that is free of media into a collection tank (not shown). The gutter 490 can be on one, two, three, or four sides of the mill, depending on need.

During continuous operation of the particle impingement fracture device 400, the particle impingement zones or media gap between media is kept open and moving through mechanical agitation to ensure that the media is always evenly distributed and that the slurry cannot tunnel a pathway (e.g., "rathole") without passing through the bulk volume or tortuous pathway of impingement zones between media. The slurry takes a tortuous impingement pathway in the first agitation zone 420 and second agitation zone 430. The slurry particles are constantly forced through impingement zones between media particles in the viscous agitation zones 420 and 430 due to the combination of the hydraulic pressure caused by continuously pumping slurry through the particle impingement fracture device 400 and the agitation of the media and slurry in the agitation zones.

Portions of the heterogeneous material that are softer and/or more friable than the media are fractured into smaller pieces as they are forced through impingement zones between media in the agitation zones. There is no appreciable increase in temperature of the slurry and media, which indicates that significant friction and collision energy is not causing kinetic energy to be converted into heat.

The disclosed impingement particle fracture of heterogeneous material works best when a component of the heterogeneous material is friable. Additionally, if the particle is a perfect sphere of homogeneous material, it will not fracture and break down into smaller particles in the disclosed process.

The disclosed process creates a series of impingement zones. Forcing a slurry that contains particles of heterogeneous material through these impingement zones causes inter-particle impingement and creates intra-particle stress at heterogeneous interfaces. In the example of the heterogeneous material coal, because the coal particles are largely composed of a "soft" carbonaceous matter with "hard" mineral matter impurities dispersed throughout the particle, stress concentration is induced at the interface between the carbonaceous matter and the mineral matter.

The disclosed process only breaks down the particles until the particles are substantially free of dissimilarity; at that point, the particles do not break down any further. In the case of coal, the mineral matter impurity is already small and harder than coal. It does not break down or fracture to smaller particles in this process. It is only liberated from the coal particles during the impingement induced fracture of particles. In contrast, if a heterogenous material is placed in a conventional mill and allowed to continue grinding, all the particles will continue to mill to smaller and smaller sizes. Resultantly, efficiency goes down.

The disclosed process promotes impingement induced collision of particles. The process utilizes a high solids content slurry in which particles are suspended in fluid, yet almost touching each other. The high solids content slurry is passed through narrow impingement zones at a high velocity to induce particle-to-particle impingement.

The disclosed type of impingement particle fracture of heterogeneous material to reduce particle size is independent of the initial particle size. Unlike conventional milling processes, the disclosed comminution process will work on particles up to 6 mm in diameter and down to 1 um or less in size.

The disclosed process is particularly useful with friable materials. An advantage of the disclosed process is to use the friability of the heterogeneous particle matrix material to assist in breaking down the particles in a mixture with a harder media material. In the disclosed acceleration impingement event, the friable material collides with itself and breaks down. The friable component of the heterogeneous material breaks more easily at boundaries along the interfaces between the harder and softer heterogeneous material components. Stress concentration points are created by the dissimilar materials which aid in rapid, low energy particle comminution through impingement.

The disclosed process provides a reduction in particle size of the softer matrix material without reducing the size of the harder material. All the other milling processes reduce the size of all materials.

The following non-limiting examples are given to illustrate embodiments relating to the disclosed process for reducing the particle size of heterogeneous material. It is to be understood that these examples are neither comprehensive nor exhaustive of the many types of embodiments which can be practiced in accordance with the presently disclosed invention.

Example 1

A continuous impingement fracture device configured as shown in FIG. 4 was operated. This impingement fracture device consisted of seven 4 foot wide by 4 foot long by 4 foot tall sections. The bottom two sections (420) had double shaft paddle mixers in them. Mechanical agitation in this section mixed the media and slurry together causing impingement fracture interactions to occur. The impingement media extended to the middle of section 430 through flow mixing, providing further opportunity for impingement fracture to occur as slurry particles passed through impingement gaps between the media. About 50% to 55% of the volume of bottom three sections (two sections with mechanical agitation and one section with flow mixing) was occupied by impingement media. The remaining 45% to 50% of the volume was occupied by the slurry between the impingement media. The solids content of the slurries tested in the continuous impingement fracture device varied from 20 to 35 wt. % solids in different tests. Tests were done with the solids content of the slurry as high as 45 wt. % and 50 wt. %

For the test reported on in this example, a feed slurry of coal particles had a solids content of 30% by weight. Ash or mineral content of the coal particles in the slurry was usually about 45 wt. % on a dry basis. 24.9 cubic meters per hour wet slurry at a solids content of 30 wt. % and an ash content of 45 wt. % on a dry basis was pumped continuously through the impingement fracture device. The mass flow of the slurry was 28.0 metric tons per hour (MTPH) on a wet basis and 8.4 MTPH on a dry basis. The particle size of the incoming slurry was d99 of about 200 microns and d50 12.5 microns. The particle size distribution of the slurry exiting the impingement fracture device was d99 of about 40 microns and d50 6.5 microns. Particle size distributions were characterized using a Beckman Coulter LS Particle Size Analyzer. 24.0 kW were used to power the impingement fracture device. 24.0 kW/8.4 MTPH dry slurry=2.9 kilowatt-hour (kwh) per dry metric ton of feed slurry.

Example 2

The continuous impingement fracture device was operated where the incoming slurry was 25 wt. % solids and about 16 wt. % ash on a dry basis. The mass flow of the slurry was 6.5 MTPH on a dry basis. The volumetric flow rate was 24.4 cubic meters per hour. 14.3 kW were used to power the mill under these conditions. 14.3 kW/6.5 MTPH dry slurry=2.2 kwh per dry metric ton of feed slurry.

Example 3

Figure 5A:
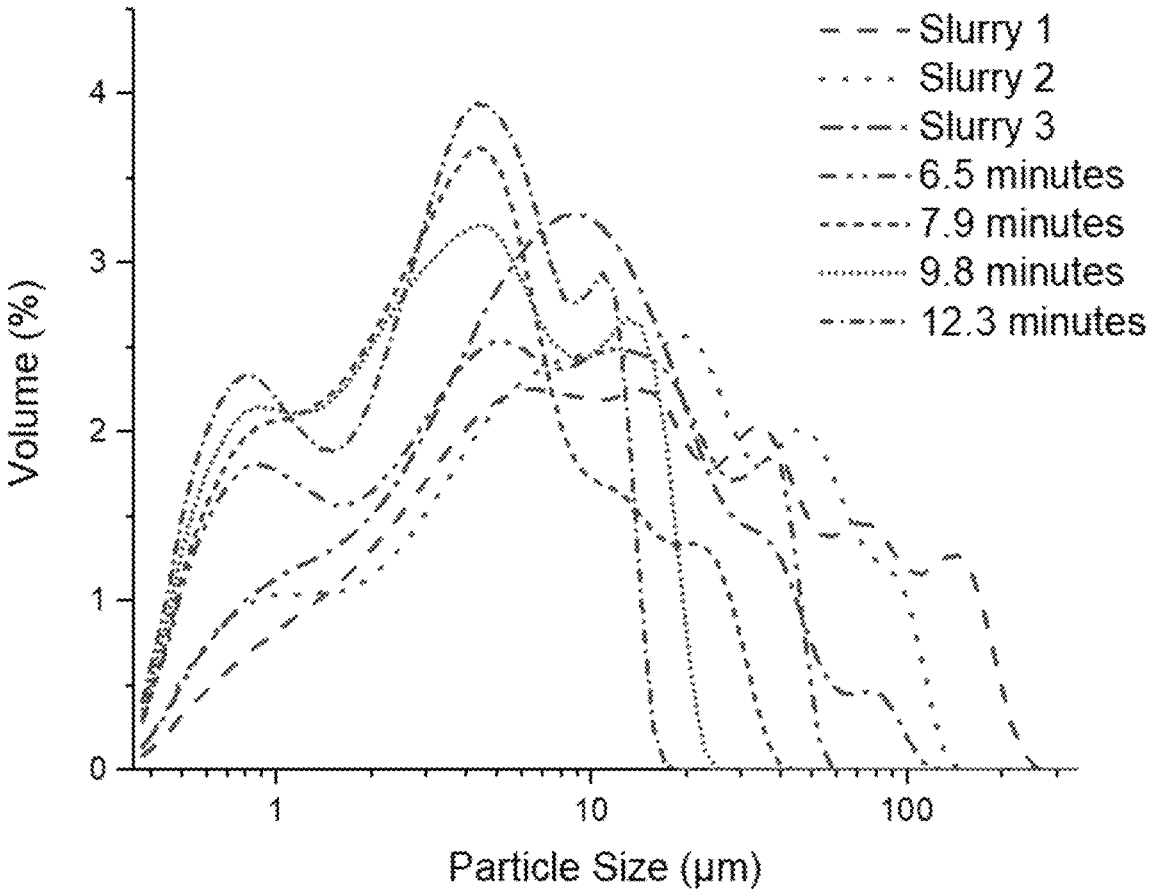
FIG. 5A is a graph showing the particle size distribution of three raw or as-received aqueous slurries and the particle size distributions of the slurries exiting the impingement fracture device after different residence times.

FIG. 5A is a graph showing the particle size distribution of three raw aqueous slurries and the particle size distributions of slurries exiting the impingement fracture device after different residence times in it. Table 1 shows average, d50, d90, and d99 particle sizes for the particle size distribution of Slurry 3 and the particle size distributions for residence times of Slurry 3 in the impingement fracture device of 6.5 minutes, 7.9 minutes, 9.8 minutes, and 12.3 minutes. Particle size distributions were characterized using a Beckman Coulter LS Particle Size Analyzer. The residence times were calculated based on the volumetric rate of slurry going through the continuous impingement fracture device and the volume occupied by the slurry between the media in the bottom three sections. As residence time increased, particles were fractured to smaller particle sizes. Table 1 also shows a magnitude of size reduction decreases with time reported as a % reductions and as a negative percentage. This was calculated by % Reduction=(reduced size−original size)/original size. For this coal sample, the particles did not fracture to a size much smaller than d99 of 20 microns and d50 3.63 microns even with longer residence times. It is thought that the distribution of inherent or entrained mineral matter in the coal particle, which are the heterogeneous points where fracture takes place, are a significant factor in the sizes that the coal particles produced via impingement fracture. For Slurry 3, the d50 reduction efficiency and d99 reduction efficiency were −52% and −76%, respectively, for 9.8 minute in the impingement fracture device. For Slurry 3, the d50 reduction efficiency and d99 reduction efficiency were −52% and −83%, respectively, for 12.3 minute in the impingement fracture device.

TABLE 1

Slurry 3 was impingement fractured at different residence times. Particle size distribution analysis data for Slurry 3 and the resulting impingement fractured slurries are shown.

| | Average | Median or d50 | d90 | d99 | d50 % Reduction | d99 % Reduction |
|---|---|---|---|---|---|---|
| Slurry 3 | 6.97 | 7.55 | 31.86 | 84.08 | | |
| 6.5 minutes residence time | 5.37 | 5.81 | 29.17 | 47.60 | −23% | −43% |
| 7.9 minutes residence time | 3.57 | 3.67 | 16.04 | 31.40 | −51% | −63% |
| 9.8 minutes residence time | 3.41 | 3.63 | 13.75 | 20.24 | −52% | −76% |
| 12.3 minutes residence time | 3.06 | 3.55 | 10.50 | 14.71 | −53% | −83% |

TABLE 2

Slurry 1 is compared to example impingement fractured slurries with particle distributions that were about d99 40 microns, d99 30 microns, d99 20 microns, and d99 15 microns after exiting the impingement fracture device.

| | Average | Median or d50 | d90 | d99 | d50 % Reduction | d99 % Reduction |
|---|---|---|---|---|---|---|
| Slurry 1 | 12.28 | 12.05 | 95.00 | 194.10 | — | — |
| Example D99 40 Impingement Fractured Slurry | 5.26 | 6.47 | 18.65 | 38.49 | −46% | −80% |
| Example D99 30 Impingement Fractured Slurry | 3.57 | 3.67 | 16.04 | 31.40 | −70% | −84% |
| Example D99 20 Impingement Fractured Slurry | 3.41 | 3.63 | 13.75 | 20.24 | −70% | −90% |
| Example D99 15 Impingement Fractured Slurry | 3.06 | 3.55 | 10.50 | 14.71 | −71% | −92% |

TABLE 3

Slurry 2 is compared to example impingement fractured slurries with particle distributions that were about d99 40 microns, d99 30 microns, d99 20 microns, and d99 15 microns after exiting the impingement fracture device.

| | Average | Median or d50 | d90 | d99 | d50 % Reduction | d99 % Reduction |
|---|---|---|---|---|---|---|
| Slurry 1 | 12.28 | 12.05 | 95.00 | 194.10 | — | — |
| Example D99 40 Impingement Fractured Slurry | 5.26 | 6.47 | 18.65 | 38.49 | −46% | −80% |
| Example D99 30 Impingement Fractured Slurry | 3.57 | 3.67 | 16.04 | 31.40 | −70% | −84% |
| Example D99 20 Impingement Fractured Slurry | 3.41 | 3.63 | 13.75 | 20.24 | −70% | −90% |
| Example D99 15 Impingement Fractured Slurry | 3.06 | 3.55 | 10.50 | 14.71 | −71% | −92% |

As heterogenous particles such as coal fracture, it has been observed that distinct populations form and then disappear as further impingement fracture takes place. Slurries 1, 2, and 3 are as-received or raw slurries of fine particle waste from a coal prep plant that underwent different processes to produce the population of particles represented by the particle size distributions shown in FIG. 5A. Slurry 1 has a 150 micron peak that Slurries 2 and 3 do not have. All of them have a peak at about 80 microns. The comparison of peaks for these three raw fine particle waste coal slurries can continue on to smaller peaks in these populations as well.

As already stated, the impingement fracture process, breaks along the weaknesses that exist at the interfaces between the heterogenous materials. The distribution heterogenous mixture creates predictable peaks for a given material. The peaks can be predicted as a material goes from large size to smaller size in an impingement fracture device as can be seen by comparing peaks in the raw slurries to the slurries produced by different residence time in the impingement fracture device as shown in FIG. 5A.

Similar particle size distributions can and have been produced by flowing Slurry 1 and Slurry 2 through the impingement fracture device for the needed residence time. This fact can be understood by comparing the peaks forming and disappearing in the fractured slurries and to the peaks in the raw slurries. Table 2 and 3 use example particle populations produced in the impingement fracture device where their particle size distribution is used to define average, median or d50, d90, and d99 particle sizes. Slurry 1 and Slurry 2 are compared to these example particle size populations produced by passing a raw fine coal waste slurry through an impingement fracture device in Table 2 and Table 3, respectively. d99% Reduction exceeds 90% for Slurry 1. d99% Reduction is greater than 85% for Slurry 2.

As the coal particle fractures to smaller sizes, the 4 to 6 micron peak and the 0.8 to 1 micron peak both grow in magnitude. It is believed that these two peaks represent two different populations of mineral matter that are liberated from the coal particles during the fracture process.

As residence time is increased, the coal particles fracture until they too have a peak at about 4 to 6 microns and are d99 of about 20 microns. The final size of the fractured coal particles is likely based on the density of mineral matter particles dispersed throughout the heterogeneous coal particle.

Figure 5B:
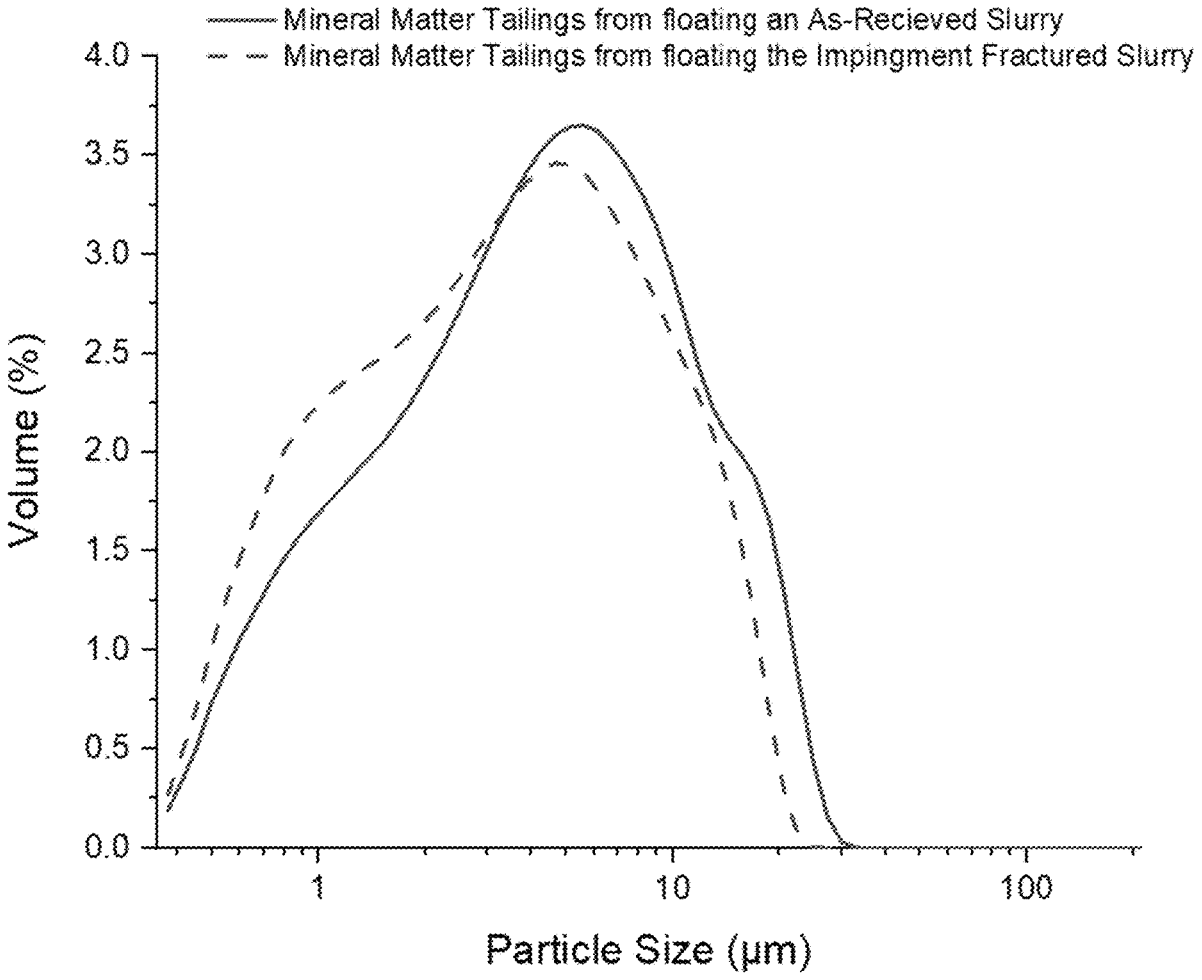
FIG. 5B is a graph of the mineral matter particle size distributions in the tailings after froth flotation of a slurries of fine coal particles and mineral particles. Both slurries were 45% ash. One particle size distribution was of the mineral matter particles in the tailings produced from a raw aqueous slurry and the other was of the mineral matter particles in the tailings produced from a slurry of particles which were fractured to a particle size of about d99 20 microns.

FIG. 5B shows mineral matter in the tailings after froth flotation of a slurries that were 45 wt. % ash on a dry basis. One slurry was the as-received or raw slurry labeled Slurry 3 in FIG. 1A. The other slurry was produced in the impingement fracture device with a 9.8 minute residence time, resulting in d99 of about 20 microns and d50 of 3.63 microns. Froth flotation separates the coal particles from the mineral matter particles. The coal particles overflow the top of the flotation cell as a coal-froth. The mineral matter flows out the bottom of the flotation cell as the tailings. The mineral matter tailings were about 82 wt. % ash on a dry basis for the tailings produced from the raw slurry and 85 wt. % ash on a dry basis for the tailings produced from the impingement fractured slurry of d99 about 20 microns. Particles size analysis was done on both mineral matter tailings to compare the mineral matter size before and after passing through the impingement fracture device. Both mineral matter tailings show the peaks at about 1 micron and about 5.5 microns. Referring back to FIG. 5A, the 1 micron peak and 5.5 micron peak grow in magnitude in the fractured slurries as more mineral matter is liberated due to increased fracture of coal particles due to longer residence time in the continuous impingement fracture device. The 1 micron peak has more particles in the tailings made from the impingement fractured slurry. There is a peak at about 20 microns in the tailings from the raw slurry that is not present in the tailings from the fractured slurry. The 20 micron peak may have been coal that did not float, possibly due to too much entrained ash. The impingent fracture process can liberate entrained ash, and allows these coal particles to float when the did not before. The higher ash content of the mineral tailings from the fractured slurry and the larger 1 micron peak are evidence that the mineral matter is liberated from the fractured coal particles.

It is important to note that the 1 micron peak and the 5.5 micron peak and associated population of particles represented by these particle size distributions were not substantially changed by the impingement fracture process. The peaks are in the same locations. The magnitudes have changed some for reasons already discussed. The only difference is the partial peak at 20 microns disappeared, which was likely coal particles as already discussed. These two peaks do not reduce in size when longer residence times induce more fracturing of the heterogeneous coal particles.

Table 4 compares the average, median or d50, d90, and d99 particle sizes for these two tailings samples. % Reduction is also shown in Table 4. Only about 20% is calculated for the mineral matter tailings after passing through the impingement fracture device. A particle is not substantially changed in size if the d50% Reduction or the d99% Reduction does not exceed −25%. By this it is meant that if a smaller particle has a % Reduction of −35%, it was substantially reduced in size.

TABLE 4

Mineral Matter Tailings from froth flotation of Surry 3 compared to impingement fractured slurry that was d99 20 microns. There is not a substantial change in size of the harder mineral matter tailings particles after impingement fracture.

| | Average | Median or d50 | d90 | d99 | d50 % Reduction | d99 % Reduction |
|---|---|---|---|---|---|---|
| Mineral Matter Tails from floating an Unmilled Slurry | 4.10 | 4.48 | 14.47 | 23.98 | — | — |
| Mineral Matter Tails from floating a Milled Slurry | 3.32 | 3.58 | 11.76 | 18.86 | −20% | −21% |

The disclosed process of reducing particle size for particles of heterogeneous material consumes less energy, generates less waste heat, and reduces media consumption to a negligible level, compared to known milling comminution processes.

The described embodiments and examples are all to be considered in every respect as illustrative only, and not as being restrictive. The scope of the invention is, therefore, indicated by the appended claims, rather than by the foregoing description. All changes that come within the meaning and range of equivalency of the claims are to be embraced within their scope.

The invention claimed is:

1. A process for comminuting particles of heterogeneous material comprising:

obtaining a quantity of feed particles comprising coal particles, wherein the coal particles comprise heterogeneous material having at least two distinct solid phases comprising a coal-derived carbonaceous matter matrix and a coal-derived mineral matter phase; and pumping a slurry of the feed particles through an agitated mixture of impingement media, wherein the impingement media has a size from 5 to 10 times larger than a size of the feed particles, wherein adjacent agitated impingement media interact to create impingement zones through which the feed particles pass and impinge each other to cause the feed particles to fracture at an interface between the coal-derived carbonaceous matter matrix and the coal-derived mineral matter phase, to liberate particles of coal-derived mineral matter, and to break the coal-derived carbonaceous matter matrix into smaller particles.

2. The process according to claim 1, wherein the impingement media is harder than the feed particles.

3. The process according to claim 1, wherein the impingement media has a size from 2 to 3 mm and wherein the feed particles have a size less than d99 0.3 mm.

4. The process according to claim 1, wherein the impingement media has a size from 0.5 mm to 1 mm and wherein the feed particles have a size less than d99 0.1 mm.

5. The process according to claim 1, wherein the smaller particles of coal-derived carbonaceous matter have a size less than 50% the size of the feed particles.

6. The process according to claim 1, wherein the smaller particles of of coal-derived carbonaceous matter have a size less than 20% the size of the feed particles.

7. The process according to claim 1, wherein the process requires an energy amount less than 10 kwh/MT of dry feed particles.

8. The process according to claim 1, wherein the process requires an energy amount less than 3 kwh/MT of dry feed particles.

9. The process according to claim 1, wherein the process requires an energy amount less than 2 kwh/MT of dry feed particles.

10. The process according to claim 1, wherein the size of the impingement media has a size diameter distribution ranging from a size of X to 2X, wherein X is the smallest diameter size of the media and 2X is the largest diameter size of the media.

11. A process to reduce a particle size of feed particles, wherein the feed particles comprise coal particles, wherein the coal particles comprise heterogenous material having at least two dissimilar solid phases comprising a coal-derived carbonaceous matter matrix and a coal-derived mineral matter phase, the process comprising:

suspending the feed particles in a moving fluid;

agitating a mixture of impingement media, wherein the impingement media have a size from 5 to 10 times larger than the particle size of the feed particles;

forming impingement zones in spaces between adjacent agitated impingement media, and pumping the moving fluid through the impingement zones to cause the feed particles to impinge each other and fracture at an interface between the coal-derived carbonaceous matter matrix and the coal-derived mineral matter phase to liberate particles of coal-derived mineral matter from the fractured coal-derived carbonaceous matter matrix.

12. The process according to claim 11, wherein the impingement media has a size from 2 to 3 mm and wherein the feed particles have a size less than d99 0.3 mm.

13. The process according to claim 11, wherein the impingement media has a size from 0.5 mm to 1 mm and wherein the feed particles have a size less than d99 0.1 mm.

14. The process according to claim 11, wherein the fractured coal-derived carbonaceous matter has a size less than 50% the size of the feed particles.

15. The process according to claim 11, wherein the process requires an energy amount less than 10 kwh/MT of dry feed particles.

16. The process according to claim 11, wherein the process requires an energy amount less than 3 kwh/MT of dry feed particles.

17. The process according to claim 11, wherein the process requires an energy amount less than 2 kwh/MT of dry feed particles.

* * * * *